US009829816B2

(12) United States Patent
Tanaka et al.

(10) Patent No.: US 9,829,816 B2
(45) Date of Patent: Nov. 28, 2017

(54) TONER

(71) Applicant: CANON KABUSHIKI KAISHA, Tokyo (JP)

(72) Inventors: Masatake Tanaka, Yokohama (JP); Yoshihiro Nakagawa, Numazu (JP); Naoya Isono, Suntou-gun (JP); Tsutomu Shimano, Mishima (JP); Shintaro Noji, Mishima (JP); Yu Yoshida, Mishima (JP); Takeshi Kaburagi, Suntou-gun (JP); Shohei Shibahara, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/736,991

(22) Filed: Jun. 11, 2015

(65) Prior Publication Data

US 2015/0370189 A1 Dec. 24, 2015

(30) Foreign Application Priority Data

Jun. 20, 2014 (JP) ..... 2014-127245
May 29, 2015 (JP) ..... 2015-110144

(51) Int. Cl.
*G03G 9/087* (2006.01)
*G03G 9/09* (2006.01)

(52) U.S. Cl.
CPC ..... *G03G 9/08755* (2013.01); *G03G 9/08711* (2013.01); *G03G 9/08795* (2013.01); *G03G 9/08797* (2013.01); *G03G 9/0904* (2013.01); *G03G 9/0906* (2013.01)

(58) Field of Classification Search
CPC ..... G03G 9/08755; G03G 9/08711
USPC ..... 430/109.4
See application file for complete search history.

(56) References Cited

U.S. PATENT DOCUMENTS

| | | | | |
|---|---|---|---|---|
| 8,609,316 | B2 | 12/2013 | Hara et al. | |
| 9,267,032 | B1 * | 2/2016 | Li | C08L 67/00 |
| 2013/0344430 | A1 * | 12/2013 | Terauchi | G03G 9/08755 430/109.31 |
| 2015/0017584 | A1 * | 1/2015 | Amemiya | G03G 9/08755 430/109.3 |
| 2015/0072278 | A1 * | 3/2015 | Mizoguchi | G03G 9/08755 430/105 |
| 2015/0153667 | A1 | 6/2015 | Noji et al. | |
| 2015/0153668 | A1 * | 6/2015 | Tanaka | G03G 9/08755 430/109.3 |
| 2015/0153669 | A1 | 6/2015 | Yoshida et al. | |
| 2015/0247000 | A1 * | 9/2015 | Moriyama | G03G 9/08755 524/604 |
| 2015/0261110 | A1 | 9/2015 | Nakagawa et al. | |

FOREIGN PATENT DOCUMENTS

| | | | |
|---|---|---|---|
| EP | 2 905 658 | A1 | 8/2015 |
| JP | 2006-113473 | A | 4/2006 |
| JP | 2008-15023 | A | 1/2008 |
| JP | 2011-141489 | A | 7/2011 |
| JP | 2011-150257 | A | 8/2011 |
| JP | 2013242509 | A * | 12/2013 |
| JP | 2014-89442 | A | 5/2014 |
| JP | 2015011054 | A * | 1/2015 |

OTHER PUBLICATIONS

English language machine translation of JP 2013-242509 (Dec. 2003).*
English language machine translation of JP 2011-150257 (Aug. 2011).*

* cited by examiner

*Primary Examiner* — Christopher Rodee
(74) *Attorney, Agent, or Firm* — Fitzpatrick Cella Harper and Scinto

(57) ABSTRACT

Provided is a toner for which the heat-resistant storability and the low-temperature fixability are able to co-exist at higher levels and for which the temporal stability of the low-temperature fixability is also excellent. The toner has a toner particle that contains a binder resin and a pigment, and this binder resin contains a polyester resin that has a specific structure and specific properties.

7 Claims, 1 Drawing Sheet

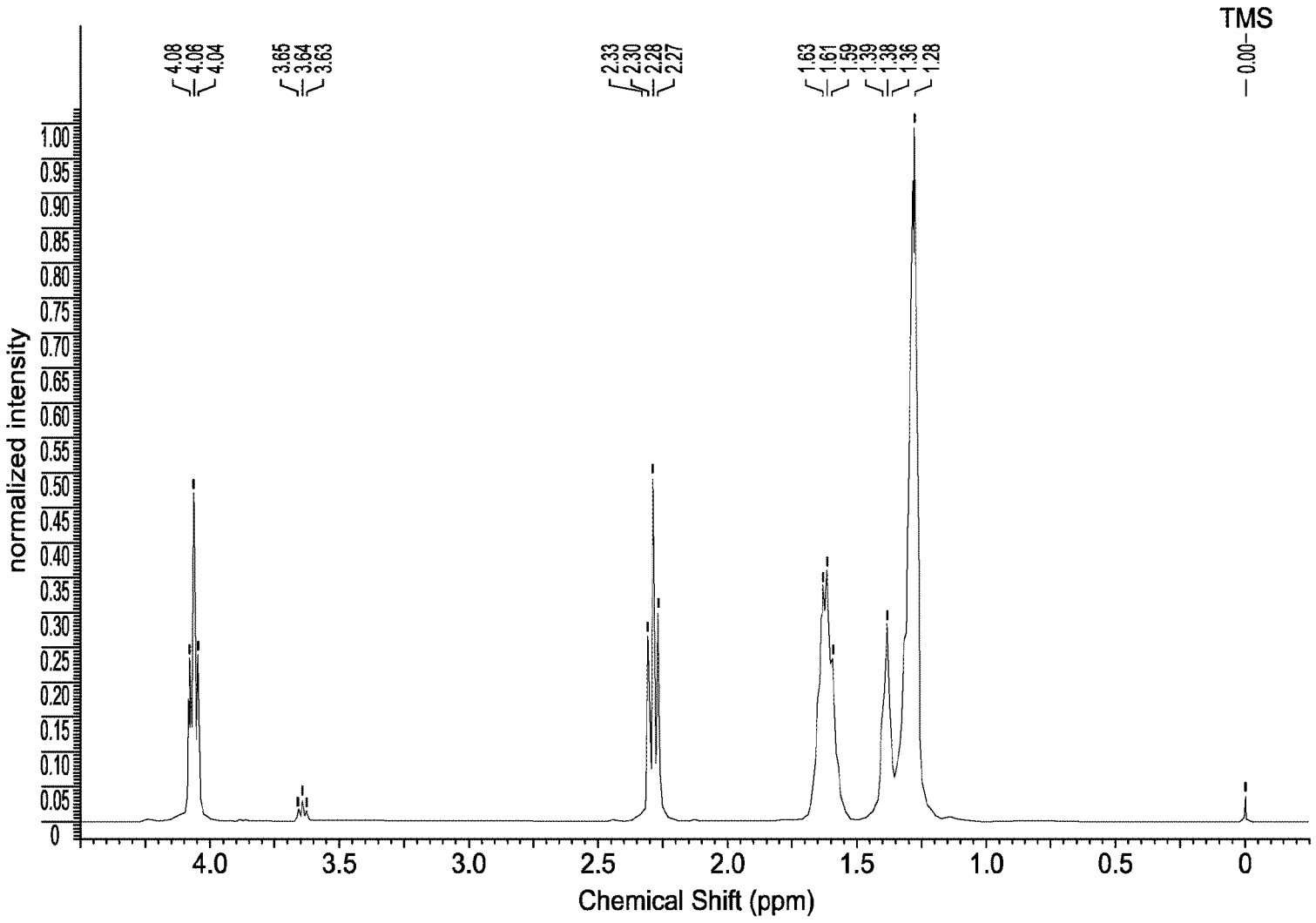
TMS
0.00
4.08
4.06
4.04
3.65
3.64
3.63
2.33
2.30
2.28
2.27
1.63
1.61
1.59
1.39
1.38
1.36
1.28
normalized intensity
1.00
0.95
0.90
0.85
0.80
0.75
0.70
0.65
0.60
0.55
0.50
0.45
0.40
0.35
0.30
0.25
0.20
0.15
0.10
0.05
0
4.0
3.5
3.0
2.5
2.0
1.5
1.0
0.5
0
Chemical Shift (ppm)

TONER

BACKGROUND OF THE INVENTION

Field of the Invention

The present invention relates to a toner for use in image-forming methods such as electrophotographic methods, electrostatic recording methods, and toner jet methods.

Description of the Related Art

There has been demand in recent years for higher speeds and a lower energy consumption from printers and copiers, and there has thus been demand for the development of toners in which the heat-resistant storability and low-temperature fixability co-exist in good balance.

In response to this, a large number of toners that use a crystalline resin-containing binder resin have been investigated. Crystalline resins exhibit a high viscoelasticity as a solid in the temperature range below their melting point and exhibit a sharp decline in the viscoelasticity when the melting point is exceeded, and it can be expected that, by utilizing this property, the heat-resistant storability can be made to co-exist with the low-temperature fixability.

However, a problem with toners that use a crystalline resin-containing binder resin is that in actuality the crystalline resin undergoes a decline in its crystallinity and a portion of the uncrystallized crystalline resin then plasticizes the binder resin, thus ultimately causing a deterioration in the heat-resistant storability.

In response to this, Japanese Patent Application Laid-open Nos. 2006-113473 and 2011-141489 provide inventions that achieve an improved heat-resistant storability through the addition of a crystal nucleating agent to the crystalline resin-containing binder resin in order to inhibit the decline in the crystallinity of the crystalline resin.

SUMMARY OF THE INVENTION

The crystallinity decline is inhibited and the heat-resistant storability is improved by these inventions, but this inhibition of the crystallinity decline cannot be regarded as satisfactory, and a problem occurs with the temporal stability of the low-temperature fixability, i.e., recrystallization of the crystalline resin occurs due to the thermal history endured by the toner during toner storage and the low-temperature fixability then deteriorates as a result.

The problem to be solved by the present invention is to provide a toner for which the heat-resistant storability and the low-temperature fixability are able to co-exist at higher levels and the temporal stability of the low-temperature fixability is also excellent.

As a result of intensive investigations in order to solve this problem, the present inventors discovered that, by having a toner particle that contains a prescribed pigment and a binder resin that contains a crystalline polyester resin with a prescribed structure, a toner is obtained for which the heat-resistant storability and the low-temperature fixability are able to co-exist at higher levels and the temporal stability of the low-temperature fixability is also excellent. This invention was achieved based on this discovery.

The present invention relates to a toner that has a toner particle containing a binder resin and a pigment, wherein the binder resin contains a crystalline polyester resin, the pigment is at least one of an organic pigment and a carbon black, the crystalline polyester resin is obtained by condensation polymerization of a monomer (a) selected from the monomer group A described below and a monomer (b) selected from the monomer group B described below, the polyester resin has a content X (mol %) of the unit derived from the monomer (b), as calculated with the following formula (1), of from 1.0 mol % to 30.0 mol %:

$$X=\{Mb/(Ma+Mb)\}\times 100 \quad (1)$$

where

Ma (mol/g) is the number of moles of the unit derived from the monomer (a) per unit mass, and Mb (mol/g) is the number of moles of the unit derived from the monomer (b) per unit mass, and the melting point of the crystalline polyester resin is from 50° C. to 85° C., Monomer Group A:

an α,ω-straight-chain aliphatic diol having from 2 to 11 carbons;

an α,ω-straight-chain aliphatic dicarboxylic acid having from 2 to 13 carbons;

an α,ω-straight-chain aliphatic monohydroxymonocarboxylic acid having from 2 to 12 carbons;

an intramolecular anhydride of an α,ω-straight-chain aliphatic dicarboxylic acid having from 2 to 13 carbons;

an alkylester of an α,ω-straight-chain aliphatic dicarboxylic acid having from 2 to 13 carbons;

an alkylester of an α,ω-straight-chain aliphatic monohydroxymonocarboxylic acid having from 2 to 12 carbons; and a lactonized compound of an α,ω-straight-chain aliphatic monohydroxymonocarboxylic acid having from 2 to 12 carbons;

Monomer Group B:

an α,ω-straight-chain aliphatic diol having from 12 to 22 carbons;

an α,ω-straight-chain aliphatic dicarboxylic acid having from 14 to 24 carbons;

an α,ω-straight-chain aliphatic monohydroxymonocarboxylic acid having from 13 to 23 carbons;

an intramolecular anhydride of an α,ω-straight-chain aliphatic dicarboxylic acid having from 14 to 24 carbons;

an alkylester of an α,ω-straight-chain aliphatic dicarboxylic acid having from 14 to 24 carbons;

an alkylester of an α,ω-straight-chain aliphatic monohydroxymonocarboxylic acid having from 13 to 23 carbons; and a lactonized compound of an α,ω-straight-chain aliphatic monohydroxymonocarboxylic acid having from 13 to 23 carbons.

The present invention can provide a toner for which the heat-resistant storability and the low-temperature fixability co-exist at higher levels and the temporal stability of the low-temperature fixability is also excellent.

Further features of the present invention will become apparent from the following description of exemplary embodiments (with reference to the attached drawings).

BRIEF DESCRIPTION OF THE DRAWINGS

FIG. 1 The drawing Figure shows the 1H-NMR spectrum of polyester resin 1.

DESCRIPTION OF THE EMBODIMENTS

The present invention is more particularly described in the following.

The toner of the present invention is a toner that has a toner particle that contains a binder resin and a pigment, wherein the binder resin contains a polyester resin (referred to in the following as the crystalline polyester resin) and the pigment is at least one of an organic pigment and a carbon black. The crystalline polyester resin is obtained by condensation polymerization of a monomer (a) selected from the monomer group A described below and a monomer (b) selected from the monomer group B described below. The crystalline polyester resin has a content X (mol %) of the unit derived from the monomer (b), as calculated with the following formula (1), of from 1.0 mol % to 30.0 mol %, and the melting point of the crystalline polyester resin is from 50° C. to 85° C.

$$X=\{Mb/(Ma+Mb)\}\times 100 \quad (1)$$

In formula (1), Ma (mol/g) represents the number of moles of the unit derived from the monomer (a) per unit mass. Mb (mol/g) represents the number of moles of the unit derived from the monomer (b) per unit mass.

Monomer Group A:

an α,ω-straight-chain aliphatic diol having from 2 to 11 carbons;

an α,ω-straight-chain aliphatic dicarboxylic acid having from 2 to 13 carbons;

an α,ω-straight-chain aliphatic monohydroxymonocarboxylic acid having from 2 to 12 carbons;

an intramolecular anhydride of an α,ω-straight-chain aliphatic dicarboxylic acid having from 2 to 13 carbons;

an alkylester of an α,ω-straight-chain aliphatic dicarboxylic acid having from 2 to 13 carbons;

an alkylester of an α,ω-straight-chain aliphatic monohydroxymonocarboxylic acid having from 2 to 12 carbons; and a lactonized compound of an α,ω-straight-chain aliphatic monohydroxymonocarboxylic acid having from 2 to 12 carbons Monomer Group B:

an α,ω-straight-chain aliphatic diol having from 12 to 22 carbons;

an α,ω-straight-chain aliphatic dicarboxylic acid having from 14 to 24 carbons;

an α,ω-straight-chain aliphatic monohydroxymonocarboxylic acid having from 13 to 23 carbons;

an intramolecular anhydride of an α,ω-straight-chain aliphatic dicarboxylic acid having from 14 to 24 carbons;

an alkylester of an α,ω-straight-chain aliphatic dicarboxylic acid having from 14 to 24 carbons;

an alkylester of an α,ω-straight-chain aliphatic monohydroxymonocarboxylic acid having from 13 to 23 carbons; and a lactonized compound of an α,ω-straight-chain aliphatic monohydroxymonocarboxylic acid having from 13 to 23 carbons The mechanism by which the toner of the present invention exhibits the above-described effects is not entirely clear, but the following is hypothesized. It is thought that the at least one pigment selected from organic pigments and carbon black forms nuclei during crystallization of the crystalline polyester resin during toner production, thereby promoting the crystallization of the crystalline polyester resin. The crystalline polyester resin according to the present invention contains a small amount (1.0 to 30.0 mol %) of $C_{\geq 12}$ methylene chain as a substructure within the molecule, and this methylene chain is thought to have a nucleating function whereby the crystalline polyester resin itself forms crystal nuclei and to have a crystal growth rate accelerating function.

As a result of the preceding, it is thought that the crystalline polyester resin in the toner undergoes rapid crystallization with the pigment functioning as nuclei and that at the same time the crystalline polyester resin present in the toner, but removed from the pigment, itself also produces crystal nuclei and undergoes crystallization, thus achieving a thorough crystallization. A crystalline polyester resin composed of monomer units derived from monomer (b) is more resistant to melting during fixing than a crystalline polyester resin component of units derived from monomer (a), which causes the low-temperature fixability to decline. However, it is thought that this effect is suppressed with the crystalline polyester resin according to the present invention because the monomer unit derived from monomer (b) is not more than 30.0 mol % therein.

Thus, it is thought that the crystalline polyester resin—due to its thorough crystallization in the temperature range below the melting point and its thorough miscibility with the other binder resin (for example, a styrene-acrylic resin or a polyester resin) in the temperature range above the melting point—can support the co-existence of the heat-resistant storability and low-temperature fixability at higher levels and can also improve the temporal stability of the low-temperature fixability.

This crystalline polyester resin is formed from only monomers that form the ester bond through polymerization, and the crystalline polyester resin of the present invention does not encompass, for example, block-type polyester resins or graft-type polyester resins in which a different type of molecular chain, such as a vinyl polymer, is chemically bonded.

When the content X (mol %) of the unit derived from the monomer (b) is less than 1.0%, it is then difficult to obtain an improvement in the crystallinity and the toner presents a deterioration in its heat-resistant storability and in the temporal stability of the low-temperature fixability. When, on the other hand, the content X is greater than 30.0 mol %, the properties of the crystalline polyester resin, e.g., a high miscibility with the binder resin component of the toner, end up being lost.

The crystalline polyester resin in the present invention denotes a resin for which a clear endothermic peak (melting point) is observed in the reversible specific heat curve given by measurement of the changes in the specific heat using a differential scanning calorimeter as described below.

The melting point of the polyester resin according to the present invention is from 50° C. to 85° C. and is preferably from 55° C. to 80° C. Its use is problematic from the standpoint of the heat-resistant storability when the melting point is lower than 50° C. Its use is problematic from the standpoint of the low-temperature fixability when the melting point is higher than 85° C., due to the high temperatures then required in order to melt the crystalline polyester resin. The melting point of the crystalline polyester resin can be controlled using, for example, the monomer combination making up the crystalline polyester resin and the molecular weight of the crystalline polyester resin.

The α,ω-straight-chain aliphatic diol having from 2 to 11 carbons in monomer group A can be exemplified by ethylene glycol, propylene glycol, 1,4-butanediol, 1,5-pentanediol, 1,6-hexanediol, 1,7-heptanediol, 1,8-octanediol, 1,9-nonanediol, 1,10-decanediol, and 1,11-undecanediol. A mixture of these may also be used.

The α,ω-straight-chain aliphatic dicarboxylic acid having from 2 to 13 carbons in monomer group A can be exemplified by oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, and 1,11-undecanedicarboxylic acid. A mixture of these may also be used. These may also be used in the reaction in the form of a compound provided by the anhydrization of the carboxyl groups or a compound provided by alkyl esterification (preferably $C_{1-4}$).

The α,ω-straight-chain aliphatic monohydroxymonocarboxylic acid having from 2 to 12 carbons in monomer group A can be exemplified by hydroxyacetic acid, 3-hydroxypropionic acid, 4-hydrobutanoic acid, 5-hydroxypentanoic acid, 6-hydroxyhexanoic acid, 7-hydroxyheptanoic acid, 8-hydroxyoctanoic acid, 9-hydroxynonanoic acid, 10-hydroxydecanoic acid, 11-hydroxyundecanoic acid, and 12-hydroxydodecanoic acid. A mixture of these may also be used. These may also be used in the reaction in the form of a lactonized compound or a compound provided by the alkyl esterification (preferably $C_{1-4}$) of the carboxyl group.

Monomer group A is more preferably α,ω-straight-chain aliphatic diol having from 2 to 10 carbons, α,ω-straight-chain aliphatic dicarboxylic acid having from 2 to 12 carbons, and α,ω-straight-chain aliphatic monohydroxymonocarboxylic acid having from 2 to 11 carbons.

The α,ω-straight-chain aliphatic diol having from 12 to 22 carbons in monomer group B can be exemplified by 1,12-dodecanediol, 1,13-tridecanediol, 1,14-tetradecanediol, 1,15-pentadecanediol, 1,16-hexadecanediol, 1,17-heptadecanediol, 1,18-octadecanediol, 1,19-nonadecanediol, 1,20-eicosanediol, 1,21-heneicosanediol, and 1,22-docosanediol. A mixture of these may also be used.

The α,ω-straight-chain aliphatic dicarboxylic acid having from 14 to 24 carbons in monomer group B can be exemplified by 1,12-dodecanedicarboxylic acid, 1,13-tridecanedicarboxylic acid, 1,14-tetradecanedicarboxylic acid, 1,15-pentadecanedicarboxylic acid, 1,16-hexadecanedicarboxylic acid, 1,17-heptadecanedicarboxylic acid, 1,18-octadecanedicarboxylic acid, 1,19-nonadecanedicarboxylic acid, 1,20-eicosanedicarboxylic acid, 1,21-heneicosanedicarboxylic acid, and 1,22-docosanedicarboxylic acid. A mixture of these may also be used. These may also be used in the reaction in the form of a compound provided by the anhydrization of the carboxyl groups or a compound provided by alkyl esterification (preferably $C_{1-4}$).

The α,ω-straight-chain aliphatic monohydroxymonocarboxylic acid having from 13 to 23 carbons in monomer group B can be exemplified by 13-hydroxytridecanoic acid, 14-hydroxytetradecanoic acid, 15-hydroxypentadecanoic acid, 16-hydroxyhexadecanoic acid, 17-hydroxyheptadecanoic acid, 18-hydroxyoctadecanoic acid, 19-hydroxynonadecanoic acid, 20-hydroxyeicosanoic acid, 21-hydroxyheneicosanoic acid, 22-hydroxydocosanoic acid, and 23-hydroxytricosanoic acid. A mixture of these may be used. These may also be used in the reaction in the form of a compound provided by lactonization or a compound provided by alkyl esterification of the carboxyl group (preferably $C_{1-4}$).

The crystalline polyester resin is preferably a ternary copolymer obtained by the condensation polymerization of two species of monomer (a) and 1 species of monomer (b) or 1 species of monomer (a) and 2 species of monomer (b) for the excellent low-temperature fixability thereby provided and for the ease of acquisition of the starting materials.

Within a range in which the objects of the present invention are not impaired, other monomer may be reacted into the crystalline polyester resin in addition to the monomers selected from monomer group A and monomer group B. Examples here are aromatic dicarboxylic acids, branched aliphatic dicarboxylic acids, cyclic aliphatic dicarboxylic acids, aromatic diols, branched aliphatic diols, and cyclic aliphatic diols.

In specific terms, the aromatic dicarboxylic acids can be exemplified by phthalic acid, isophthalic acid, and terephthalic acid. The branched aliphatic dicarboxylic acids can be exemplified by dimethylmalonic acid, isopropylmalonic acid, diethylmalonic acid, 1-methylbutylmalonic acid, dipropylmalonic acid, and diisobutylmalonic acid.

The cyclic aliphatic dicarboxylic acids can be exemplified by 1,4-cyclohexanedicarboxylic acid and 1,3-adamantanedicarboxylic acid.

The aromatic diols can be exemplified by polyoxypropylene adducts on 2,2-bis(4-hydroxyphenyl)propane and polyoxyethylene adducts on 2,2-bis(4-hydroxyphenyl)propane.

The branched aliphatic diols can be exemplified by 3-methyl-1,3-butanediol, neopentyl glycol, pinacol, 2-ethyl-1,3-hexanediol, 2,2,4-trimethyl-1,3-pentanediol, 3,5-dimethyl-2,4-docosanediol, and 1,4-cyclohexanediol.

The cyclic aliphatic diol can be exemplified by 1,4-cyclohexanediol, 1,4-cyclohexanedimethanol, and 2,2-bis(4-hydroxycyclohexyl)propane.

An end-capping agent may be used with the crystalline polyester resin within a range in which the objects of the present invention are not impaired. The use of an end-capping agent makes it possible to conveniently adjust, for example, the molecular weight, acid value, hydroxyl value, and so forth, of the crystalline polyester resin. The end-capping agent can be exemplified by monobasic acids and derivatives thereof and monohydric alcohols.

In specific terms, the monobasic acid and derivatives thereof can be exemplified by acetic acid, propanoic acid, butanoic acid, pentanoic acid, hexanoic acid, heptanoic acid, octanoic acid, nonanoic acid, decanoic acid, benzoic acid, and the acid anhydrides of the preceding.

The monohydric alcohols can be exemplified by methanol, ethanol, propanol, butanol, pentanol, hexanol, heptanol, octanol, nonanol, and decanol.

The content X (mol %) of the unit derived from the monomer (b) is preferably from 3.0 mol % to 12.0 mol %.

The content of the crystalline polyester resin in the binder resin incorporated in the toner particle is preferably from 3.0 mass % to 30.0 mass % based on the total mass of the binder resin. When in this range, an effect is obtained whereby the crystalline polyester resin plasticizes the binder resin during toner melting and the adhesiveness between the paper and toner is then improved, an excellent fixed image strength is generated, and the low-temperature fixability is improved. The content of the crystalline polyester resin in the binder resin is more preferably from 5.0 mass % to 20 mass %.

For example, a polyester resin or styrene-acrylic resin may be used as the binder resin in the present invention. A styrene-acrylic resin is preferred from the standpoint of enhancing the affinity due to the introduction of the unit derived from the monomer (b) and achieving additional improvements in the low-temperature fixability.

The content of the styrene-acrylic resin and/or polyester resin in the binder resin in the present invention is preferably from 70 mass % to 97 mass % and more preferably from 80 mass % to 95 mass %.

Radical-polymerizable vinylic polymerizable monomers can be used in the present invention as the polymerizable monomer that constitutes the styrene-acrylic resin. Monofunctional polymerizable monomers and polyfunctional polymerizable monomers can be used for this vinylic polymerizable monomer.

The monofunctional polymerizable monomer can be exemplified by the following: styrene and styrene derivatives such as α-methylstyrene, β-methylstyrene, o-methylstyrene, m-methylstyrene, p-methylstyrene, 2,4-dimethyl-styrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene;

acrylic polymerizable monomers such as methyl acrylate, ethyl acrylate, n-propyl acrylate, isopropyl acrylate, n-butyl acrylate, isobutyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate, and 2-benzoyloxyethyl acrylate; and methacrylic polymerizable monomers such as methyl methacrylate, ethyl methacrylate, n-propyl methacrylate, isopropyl methacrylate, n-butyl methacrylate, isobutyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate, and dibutyl phosphate ethyl methacrylate.

The polyfunctional polymerizable monomer can be exemplified by diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis(4-(acryloxydiethoxy)phenyl)propane, trimethylolpropane triacrylate, tetramethylolmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis(4-(methacryloxydiethoxy)phenyl)propane, 2,2'-bis(4-(methacryloxypolyethoxy)phenyl)propane, trimethylolpropane trimethacrylate, tetramethylolmethane tetramethacrylate, divinylbenzene, divinylnaphthalene, and divinyl ether.

A single monofunctional polymerizable monomer or a combination of two or more monofunctional polymerizable monomers may be used; or a monofunctional polymerizable monomer+polyfunctional polymerizable monomer combination may be used; or a single polyfunctional polymerizable monomer or a combination of two or more polyfunctional polymerizable monomers may be used. Among these polymerizable monomers, a styrene-acrylic resin made from a mixture of acrylic polymerizable monomer with a single selection or two or more selections from styrene and styrene derivatives is preferred from the standpoint of the developing characteristics and the durability.

There are no particular limitations in the present invention on the method of toner particle production. The toner of the present invention may be produced not only by a conventional pulverization method for toner production, but also by various chemical toner production methods, such as suspension polymerization methods, emulsion polymerization methods, suspension granulation methods, and emulsion aggregation methods.

A toner particle production method using a suspension polymerization method is described in the following.

The above-described polymerizable monomer that will form the binder resin, the crystalline polyester resin of the present invention, pigment, and other optional additives, e.g., wax, are dissolved or dispersed to uniformity using a dispersing device such as a homogenizer, ball mill, colloid mill, or ultrasonic disperser, and a polymerization initiator is dissolved therein to produce a polymerizable monomer composition. This polymerizable monomer composition is suspended in an aqueous medium that contains a dispersion stabilizer, and polymer particles are then produced by carrying out a polymerization.

The polymerization initiator may be added at the same time as the addition of the other additives to the polymerizable monomer or may be admixed just prior to suspension in the aqueous medium. In addition, the polymerization initiator may be added, dissolved in polymerizable monomer or a solvent, immediately after granulation but prior to the start of the polymerization reaction.

A polar resin is preferably added to the polymerizable monomer composition in the case of a polymerization method that uses an aqueous medium, such as suspension polymerization methods. The addition of the polar resin functions to promote encapsulation of the crystalline polyester resin of the present invention and wax.

When a polar resin is present in the polymerizable monomer composition suspended in the aqueous medium, due to the different affinities with water the polar resin readily migrates to the vicinity of the interface between the aqueous medium and the polymerizable monomer composition, and as a consequence the polar resin undergoes segregation to the surface of the toner particle. The toner particle has a core-shell structure as a result.

In addition, when a polar resin with a high melting temperature is selected for the polar resin used for the shell, the occurrence of blocking during toner storage can then be suppressed even in the case of a design in which, with the goal of low-temperature fixing, the binder resin melts at a lower temperature.

Polyester resins and carboxyl-containing styrenic resins are preferred for the polar resin. By using a polyester resin or carboxyl-containing styrenic resin as the polar resin, the lubricity intrinsic to these resins can then be expected to appear when these resins form a shell through segregation to the toner particle surface.

Resins provided by the condensation polymerization of an acid component monomer as exemplified in the following with an alcohol component monomer as exemplified in the following can be used as the polyester resin in the polar resin context. The acid component monomer can be exemplified by terephthalic acid, isophthalic acid, phthalic acid, fumaric acid, maleic acid, malonic acid, succinic acid, glutaric acid, adipic acid, pimelic acid, suberic acid, azelaic acid, sebacic acid, camphoric acid, cyclohexanedicarboxylic acid, and trimellitic acid.

The alcohol component monomer can be exemplified by alkylene glycols and polyalkylene glycols, such as ethylene glycol, diethylene glycol, triethylene glycol, 1,2-propylene glycol, 1,3-propylene glycol, 1,4-butanediol, neopentyl glycol, and 1,4-bis(hydroxymethyl)cyclohexane, as well as by bisphenol A, hydrogenated bisphenols, ethylene oxide adducts on bisphenol A, propylene oxide adducts on bisphenol A, glycerol, trimethylolpropane, and pentaerythritol.

The carboxyl group-containing styrenic resin in the polar resin context is preferably, for example, a styrenic acrylic acid copolymer, a styrenic methacrylic acid copolymer, or a styrenic maleic acid copolymer. In particular, styrene-acrylate ester-acrylic acid copolymers support facile control of the amount of charge and are thus preferred.

In addition, the carboxyl group-containing styrenic resin more preferably contains a monomer that has a primary or secondary hydroxyl group. Specific polymer compositions can be exemplified by styrene-2-hydroxyethyl methacrylate-methacrylic acid-methyl methacrylate copolymers, styrene-n-butyl acrylate-2-hydroxyethyl methacrylate-methacrylic acid-methyl methacrylate copolymers, and styrene-α-methylstyrene-2-hydroxyethyl methacrylate-methacrylic acid-methyl methacrylate copolymers. A resin that incorporates a monomer that has a primary or secondary hydroxyl group has a high polarity and provides a better long-term standing stability.

The content of this polar resin, expressed per 100.0 mass parts of the binder resin, is preferably from 1.0 mass parts to 20.0 mass parts and is more preferably from 2.0 mass parts to 10.0 mass parts.

A known wax can be used in the toner according to the present invention. Specific examples here are petroleum-based waxes such as paraffin waxes, microcrystalline waxes, and petrolatum, and their derivatives; montan wax and derivatives thereof; hydrocarbon waxes produced by the Fischer-Tropsch method, and derivatives thereof; polyolefin waxes, as typified by polyethylene, and derivatives thereof; and natural waxes, as typified by carnauba wax and candelilla wax, and derivatives thereof, wherein the derivatives also include oxidation products, block copolymers with vinyl monomer, and graft modifications. Additional examples are alcohols such as higher aliphatic alcohols; fatty acids such as stearic acid and palmitic acid and their amides, esters, and ketones; hydrogenated castor oil and derivatives thereof; vegetable waxes; and animal waxes. A single one of these may be used or combinations may be used.

Among the preceding, the use of polyolefins, hydrocarbon waxes produced by the Fischer-Tropsch method, and petroleum-based waxes is preferred because this supports a trend of improvement in the developing performance and transferability. An oxidation inhibitor may be added to these waxes in a range that does not influence the charging performance of the toner. These waxes are used preferably at from 1.0 mass parts to 30.0 mass parts per 100.0 mass parts of the binder resin.

The melting point of the wax used by the present invention is preferably from 30° C. to 120° C. and is more preferably from 60° C. to 100° C.

A release effect is efficiently generated and a satisfactory fixing region is secured by using a wax that exhibits such thermal properties.

The toner according to the present invention contains at least one of an organic pigment and a carbon black as a pigment. The organic pigment is exemplified by cyan pigments, magenta pigments, and yellow pigments.

The cyan pigment can be exemplified by copper phthalocyanine compounds and derivatives thereof, anthraquinone compounds, and basic dye lake compounds. The following are specific examples: C. I. Pigment Blue 1, 7, 15, 15:1, 15:2, 15:3, 15:4, 60, 62, and 66.

The magenta pigment can be exemplified by the following: condensed azo compounds, diketopyrrolopyrrole compounds, anthraquinone, quinacridone compounds, basic dye lake compounds, naphthol compounds, benzimidazolone compounds, thioindigo compounds, and perylene compounds. Specific examples are as follows: C. I. Pigment Red 2, 3, 5, 6, 7, 23, 48:2, 48:3, 48:4, 57:1, 81:1, 122, 144, 146, 150, 166, 169, 177, 184, 185, 202, 206, 220, 221, and 254 and C. I. Pigment Violet 19.

The yellow pigment can be exemplified by condensed azo compounds, isoindolinone compounds, anthraquinone compounds, azo metal complexes, methine compounds, and allylamide compounds. Specific examples are as follows: C. I. Pigment Yellow 12, 13, 14, 15, 17, 62, 74, 83, 93, 94, 95, 97, 109, 110, 111, 120, 127, 128, 129, 147, 151, 154, 155, 168, 174, 175, 176, 180, 181, 185, 191, and 194.

The black pigment can be exemplified by carbon black and pigments adjusted to a black color using the above-described yellow pigment, magenta pigment, and cyan pigment.

A single one of these pigments or a mixture of these pigments can be used, and these pigments can be used in the form of a solid solution. The pigment used in the present invention is selected considering the crystallinity of the crystalline polyester resin and also considering the hue angle, chroma, lightness, lightfastness, OHP transparency, and dispersibility in the toner particle. A dye may also be used.

The pigment is preferably used at from 1.0 mass parts to 20.0 mass parts per 100.0 mass parts of the binder resin.

When the toner particle is obtained by a suspension polymerization method, the use is preferred —based on a consideration of the aqueous phase transferability and the polymerization inhibitory activity possessed by colorants— of a colorant on which a hydrophobic treatment has been executed using a material that does not inhibit the polymerization. In an example of a preferred method for carrying out a hydrophobic treatment on the colorant, a colored polymer is obtained by the preliminary polymerization of a polymerizable monomer in the presence of the colorant and the obtained colored polymer is added to the polymerizable monomer composition.

In the case of carbon black, the same hydrophobic treatment as described above for colorants may be carried out, or a treatment may be carried out using a material (polyorganosiloxane) that can react with the surface functional groups on carbon black.

The toner according to the present invention may use a charge control agent or a charge control resin.

A known charge control agent may be used, but in particular a charge control agent is preferred that supports a rapid triboelectric charging speed and that can stably maintain a constant triboelectric charge quantity. In addition, when the toner particle is produced by a suspension polymerization method, the charge control agent particularly preferably has little ability to inhibit the polymerization and substantially is not a material that can solubilize into the aqueous medium.

Charge control agents include charge control agents that can control the toner to a negative chargeability and charge control agents that can control the toner to a positive chargeability. The following are examples of charge control agents that can control the toner to a negative chargeability: monoazo metal compounds; acetylacetone metal compounds; metal compounds of aromatic oxycarboxylic acids, aromatic dicarboxylic acids, oxycarboxylic acids, and dicarboxylic acids; aromatic oxycarboxylic acids and aromatic mono- and polycarboxylic acids and their metal salts, anhydrides, and esters; phenolic derivatives such as bisphenols; urea derivatives; metal-containing salicylic acid compounds; metal-containing naphthoic acid compounds; boron compounds; quaternary ammonium salts; calixarene; and charge control resins.

The following are examples of charge control agents that can control the toner to a positive chargeability: guanidine compounds; imidazole compounds; quaternary ammonium salts such as tributylbenzylammonium 1-hydroxy-4-naphthosulfonate and tetrabutylammonium tetrafluoroborate, and the onium salts, e.g., phosphonium salts, that are analogues of the preceding, as well as their lake pigments; triphenylmethane dyes and their lake pigments (the laking agent is phosphotungstic acid, phosphomolybdic acid, phosphotungstomolybdic acid, tannic acid, lauric acid, gallic acid, ferricyanide, or ferrocyanide); metal salts of higher fatty acids; and charge control resins.

A single one of these charge control agents and charge control resins may be added by itself or a combination of two or more may be added.

Among these charge control agents, metal-containing salicylic acid compounds are preferred and those in which the metal is aluminum or zirconium are particularly preferred.

The amount of addition of the charge control agent or charge control resin, expressed per 100.0 mass parts of the binder resin, is preferably from 0.01 mass parts to 20.0 mass parts and is more preferably from 0.5 mass parts to 10.0 mass parts.

On the other hand, a polymer or copolymer having the sulfonic acid group, sulfonate salt group, or sulfonate ester group can be used as the charge control resin. The polymer having the sulfonic acid group, sulfonate salt group, or sulfonate ester group is particularly preferably a polymer that contains at least 2 mass %, as the copolymerization percentage, of a sulfonic acid group-containing acrylamide monomer or sulfonic acid group-containing methacrylamide monomer, while a polymer containing at least 5 mass % is more preferred.

The charge control resin preferably has a glass transition temperature (Tg) from 35° C. to 90° C., a peak molecular weight (Mp) from 10,000 to 30,000, and a weight-average molecular weight (Mw) from 25,000 to 50,000. When such a charge control resin is used, favorable triboelectric charging characteristics can be imparted without affecting the thermal characteristics required of the toner particle. Moreover, since the charge control resin contains the sulfonic acid group, this can, for example, improve the dispersibility of the pigment as well as the dispersibility of the charge control resin itself in the polymerizable monomer composition and can thereby bring about additional improvements in the tinting strength, transparency, and triboelectric charging characteristics.

The polymerization initiator can be exemplified by organoperoxide-type initiators and azo-type polymerization initiators.

The organoperoxide-type initiators can be exemplified by benzoyl peroxide, lauroyl peroxide, di-α-cumyl peroxide, 2,5-dimethyl-2,5-bis(benzoylperoxy)hexane, bis(4-t-butylcyclohexyl) peroxydicarbonate, 1,1-bis(t-butylperoxy)cyclododecane, t-butyl peroxymaleate, bis(t-butylperoxy) isophthalate, methyl ethyl ketone peroxide, tert-butyl peroxy-2-ethylhexanoate, diisopropyl peroxycarbonate, cumene hydroperoxide, 2,4-dichlorobenzoyl peroxide, and tert-butyl peroxypivalate.

The azo-type polymerization initiators can be exemplified by 2,2'-azobis(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, azobismethylbutyronitrile, and 2,2'-azobis(methyl isobutyrate).

A redox initiator, which combines an oxidizing substance with a reducing substance, may also be used as the polymerization initiator. The oxidizing substance can be exemplified by inorganic peroxides such as hydrogen peroxide and persulfate salts (the sodium salt, potassium salt, and ammonium salt) and oxidizing metal salts such as tetravalent cerium salts. The reducing substance can be exemplified by reducing metal salts (divalent iron salts, monovalent copper salts, and trivalent chromium salts); ammonia; lower amines (amines having from about 1 to 6 carbons, e.g., methylamine and ethylamine); amino compounds such as hydroxylamine; reducing sulfur compounds, e.g., sodium thiosulfate, sodium hydrosulfite, sodium bisulfite, sodium sulfite, and sodium formaldehyde sulfoxylate; lower alcohols (from 1 to 6 carbons); ascorbic acid and its salts; and lower aldehydes (from 1 to 6 carbons).

The polymerization initiator is selected with reference to its 10-hour half-life temperature, and a single one or a mixture may be used. The amount of addition of the polymerization initiator will vary depending on the degree of polymerization being sought, but generally from 0.5 mass parts to 20.0 mass parts is added per 100.0 mass parts of the polymerizable monomer.

A known chain transfer agent and a known polymerization inhibitor may also be added in order to control the degree of polymerization.

Various crosslinking agents may also be used in the polymerization of the polymerizable monomer. The crosslinking agent can be exemplified by polyfunctional compounds such as divinylbenzene, 4,4'-divinylbiphenyl, ethylene glycol diacrylate, ethylene glycol dimethacrylate, diethylene glycol diacrylate, diethylene glycol dimethacrylate, glycidyl acrylate, glycidyl methacrylate, trimethylolpropane triacrylate, and trimethylolpropane trimethacrylate.

A known inorganic dispersion stabilizer compound or organic dispersion stabilizer compound can be used as the dispersion stabilizer used in the preparation of the aqueous medium. The inorganic dispersion stabilizer compound can be exemplified by tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina.

The organic dispersion stabilizer compound, on the other hand, can be exemplified by polyvinyl alcohol, gelatin, methyl cellulose, methyl hydroxypropyl cellulose, ethyl cellulose, the sodium salt of carboxymethyl cellulose, polyacrylic acid and salts thereof, and starch. The amount of use of these dispersion stabilizers is preferably from 0.2 mass parts to 20.0 mass parts per 100.0 mass parts of the polymerizable monomer.

When an inorganic dispersion stabilizer compound is used from among these dispersion stabilizers, a commercial product may be used as such, or the inorganic compound may be produced in the aqueous medium in order to obtain a dispersion stabilizer having an even finer particle diameter. For example, tricalcium phosphate can be obtained by mixing an aqueous sodium phosphate solution with an aqueous calcium chloride solution under high-speed stirring.

An external additive may be externally added to the toner particle in order to impart various properties to the toner. External additives for improving the flowability of the toner can be exemplified by inorganic fine particles such as silica fine particles, titanium oxide fine particles, and their composite oxide fine particles. Silica fine particles and titanium oxide fine particles are preferred among the inorganic fine particles.

For example, the toner of the present invention can be obtained by attachment to the surface of the toner particle, prior to processing, of the external additive by the external addition and mixing of inorganic fine particles with the toner particles. A known method may be used for the method for effecting the external addition of the inorganic fine particles. An example here is a method for carrying out mixing and treatment that uses a Henschel mixer (Mitsui Miike Chemical Engineering Machinery Co., Ltd.).

The silica fine particles can be exemplified by dry silicas and fumed silicas produced by the vapor-phase oxidation of a silicon halide and wet silicas produced from waterglass. A preferred inorganic fine particle is a low-$Na_2O$, low-$SO_3^{2-}$ dry silica that has little silanol group at the surface or in the interior of the silica fine particle. In addition, the dry silica may be a composite fine particle of silica and another metal oxide, as obtained by using another metal halide compound, e.g., aluminum chloride or titanium chloride, in combination with the silicon halide compound.

A hydrophobic-treated inorganic fine particle is preferably used for the inorganic fine particle because the hydrophobic treatment of the surface thereof with a treatment agent can achieve an enhanced control of the triboelectric charge quantity for the toner, an enhanced environmental stability for the toner, and an improved toner flowability at high temperatures and high humidities. When the inorganic fine particles externally added to a toner absorb moisture, the triboelectric charge quantity and flowability of the toner decline and a decline in the developing performance and transferability is then readily produced.

The treatment agent for carrying out a hydrophobic treatment on the inorganic fine particles can be exemplified by unmodified silicone varnishes, variously modified silicone varnishes, unmodified silicone oils, variously modified silicone oils, silane compounds, silane coupling agents, other organosilicon compounds, and organotitanium compounds. Silicone oils are preferred among the preceding. A single one of these treatment agents may be used or combinations may be used.

The total amount of addition of the inorganic fine particles, expressed per 100.0 mass parts of the toner particles, is preferably from 1.0 mass parts to 5.0 mass parts and is more preferably from 1.0 mass parts to 2.5 mass parts. Viewed from the perspective of the durability of the toner, the external additive preferably has a particle diameter that is not more than one-tenth of the average particle diameter of the toner particle.

The methods for measuring the various properties related to the present invention are described below.

<Method for Measuring the Molecular Weight>

The weight-average molecular weight (Mw) of the crystalline polyester resin of the present invention is measured as follows using gel permeation chromatography (GPC).

The crystalline polyester resin is first dissolved in tetrahydrofuran (THF) at room temperature. The obtained solution is filtered across a "Sample Pretreatment Cartridge" (Tosoh Corporation) solvent-resistant membrane filter with a pore diameter of 0.2 μm to obtain a sample solution. The sample solution is adjusted to provide a concentration for the THF-soluble component of 0.8 mass %. Measurement is carried out under the following conditions using this sample solution.

instrument: "HLC-8220GPC" high-performance GPC instrument (Tosoh Corporation)
column: two-column train of LF-604 (Showa Denko Kabushiki Kaisha)
eluent: THF
flow rate: 0.6 mL/min
oven temperature: 40° C.
sample injection amount: 0.020 mL A molecular weight calibration curve constructed using standard polystyrene resins (for example, product name "TSK Standard Polystyrene F-850, F-450, F-288, F-128, F-80, F-40, F-20, F-10, F-4, F-2, F-1, A-5000, A-2500, A-1000, A-500", from Tosoh Corporation) is used to calculate the molecular weight of the sample.

<Method for Measuring the Melting Point>

The melting point (Tm) of the crystalline polyester resin of the present invention is measured based on ASTM D 3418-82 using a "Q1000" (TA Instruments, Inc.) differential scanning calorimeter.

The melting points of indium and zinc are used for temperature correction in the instrument detection section, and the heat of fusion of indium is used for correction of the amount of heat.

In specific terms, 5 mg of the crystalline polyester resin is accurately weighed out; this is introduced into an aluminum pan; and the measurement is performed at a ramp rate of 10° C./min in the measurement temperature range from 30° C. to 200° C. using an empty aluminum pan for reference. In the measurement, heating is first carried out to 200° C. at the indicated ramp rate; cooling is then performed to 30° C. at a rate of temperature decline of 10° C./min; and re-heating is then carried out at a ramp rate of 10° C./min. The highest endothermic peak in the DSC curve in the temperature range from 30° C. to 200° C. in this second heating process is taken to be the melting point (Tm) by DSC measurement of the crystalline polyester resin.

<Separation from the Toner of the Crystalline Polyester Resin of the Present Invention and the Other Binder Resin Component>

The following method may be used to separate the crystalline polyester resin and the other binder resin component from the toner. Separation is carried out by the following method and the structure and various properties, e.g., the melting point, are characterized.

(Separation of the Binder Resin and Wax from the Toner by Preparative Gel Permeation Chromatography (GPC))

The tetrahydrofuran (THF)-soluble component of the toner is obtained by dissolving the toner in tetrahydrofuran (THF) and removing the solvent from the obtained soluble matter by distillation under reduced pressure.

The obtained tetrahydrofuran (THF)-soluble component of the toner is dissolved in chloroform to prepare a sample solution having a concentration of 25 mg/mL.

3.5 mL of the obtained sample solution is introduced into the instrument indicated below and the molecular weight of at least 2,000 is collected as the resin component under the following conditions.

preparative GPC instrument: Model LC-980 Preparative HPLC from Japan Analytical Industry Co., Ltd.
preparative column: JAIGEL 3H, JAIGEL 5H (Japan Analytical Industry Co., Ltd.)
eluent: chloroform
flow rate: 3.5 mL/min After collection of the resin-derived high molecular weight component, the solvent is distilled off under reduced pressure followed by drying for 24 hours under reduced pressure in a 90° C. atmosphere. This process is repeated until about 100 mg of the resin component is obtained.

(Separation of the Crystalline Polyester Resin from the Other Binder Resin Component)

100 mg of the resin obtained in the above-described process is added to 500 mL of acetone, and, after carrying out complete dissolution by heating to 70° C., the crystalline polyester resin is recrystallized by gradually cooling to 25° C. The crystalline polyester resin is subjected to suction filtration and is separated into a filtrate and the crystalline polyester resin in crystalline form.

The separated filtrate is gradually added to 500 mL of methanol and the binder resin component other than the crystalline polyester resin is reprecipitated. This is followed by recovery on a suction filter of the binder resin component other than the crystalline polyester resin.

The obtained crystalline polyester resin and other binder resin component are dried under reduced pressure for 24 hours at 40° C.

<Characterization of the Structure of the Crystalline Polyester Resin of the Present Invention and the Structure of the Other Binder Resin Component>

The structure of the crystalline polyester resin and the structure of the other binder resin component are characterized using nuclear magnetic resonance spectroscopic analysis ($^1$H-NMR) [400 MHz, $CDCl_3$, room temperature (25° C.)].

measurement instrumentation: JNM-EX400 (JEOL Ltd.) FT-NMR instrument
measurement frequency: 400 MHz
pulse condition: 5.0 μs
frequency range: 10500 Hz
number of integrations: 64 times <Measurement of the Content X of the Unit Derived from the Monomer (b) in the Crystalline Polyester Resin of the Present Invention>

The content X of the unit derived from the monomer (b) in the crystalline polyester resin is derived from the integration values in the spectrum provided by nuclear magnetic resonance spectroscopic analysis ($^1$H-NMR).

measurement instrumentation: JNM-EX400 (JEOL Ltd.) FT-NMR instrument
measurement frequency: 400 MHz
pulse condition: 5.0 μs
frequency range: 10500 Hz
number of integrations: 64 times <Measurement of the Content of the Crystalline Polyester Resin of the Present Invention in the Binder Resin Separated from the Toner>

The content of the crystalline polyester resin is derived from the integration values in the nuclear magnetic resonance spectrum ($^1$H-NMR) of the toner based on the individual nuclear magnetic resonance spectra ($^1$H-NMR) for the crystalline polyester resin and the other binder resin component.

measurement instrumentation: JNM-EX400 (JEOL Ltd.) FT-NMR instrument
measurement frequency: 400 MHz
pulse condition: 5.0 μs
frequency range: 10500 Hz
number of integrations: 64 times

EXAMPLES

The present invention is more particularly described below through examples. The present invention is not limited by the following examples. Unless specifically indicated otherwise, the number of parts and % in the examples and comparative examples are on a mass basis in all instances.

<Production of Crystalline Polyester Resin 1>

100.0 mass parts of 1,10-decanedicarboxylic acid and 47.8 mass parts of 1,6-hexanediol as monomers selected from monomer group A, 14.8 mass parts of 1,12-dodecanediol as monomer selected from monomer group B, and 0.6 mass parts of titanium(IV) isopropoxide as esterification catalyst were added to a reactor equipped with a stirrer, thermometer, nitrogen inlet line, water separator, and vacuum apparatus and were reacted for 5 hours at 160° C. under a nitrogen atmosphere. This was followed by reaction for 4 hours at 180° C. and then reaction at 180° C. and 1 hPa until the desired molecular weight was reached, thereby obtaining crystalline polyester resin 1. Structural characterization of the obtained crystalline polyester resin 1 was carried out using nuclear magnetic resonance spectroscopic analysis ($^1$H-NMR (in $CDCl_3$, room temperature (25° C.), 400 MHz)).

1H-NMR results: δ [ppm]=4.06 (40.0H, t), 3.64 (2.2H, t), 1.74-1.50 (82.0H, br), 1.49-1.34 (35.6H, br), 1.34-1.10 (148.0H, br) are illustrated in the drawing Figure.

The obtained crystalline polyester resin 1 had a clear endothermic peak in the DSC measurement, and the temperature of this peak (melting point) was 71° C. The properties of the obtained crystalline polyester resin 1 are given in Table 2.

<Production of Crystalline Polyester Resins 2 to 17>

Crystalline polyester resins 2 to 17 were obtained proceeding as in the Production of Crystalline Polyester Resin 1, but changing the starting materials as shown in Table 1. The obtained crystalline polyester resins 2 to 17 had clear endothermic peaks in the DSC measurement. The properties of the obtained crystalline polyester resins 2 to 17 are shown in Table 2.

<Production of Binder Resin Polymer 1>

The following materials were weighed into a reaction kettle equipped with a condenser, stirrer, and nitrogen inlet line.

| | |
|---|---|
| terephthalic acid | 22.6 mass parts |
| trimellitic anhydride | 1.8 mass parts |
| polyoxypropylene(2.2)-2,2-bis(4-hydroxyphenyl)propane | 75.6 mass parts |
| titanium dihydroxybis(triethanolaminate) | 0.2 mass parts |

This was followed by heating to 200° C. and reaction for 8 hours while introducing nitrogen and removing the evolved water, followed by reaction at 1 hPa until the desired molecular weight was reached to synthesize binder resin polymer 1 (polyester resin). The obtained binder resin polymer 1 had a weight-average molecular weight (Mw) of 7,500.

<Production of Comparative Polymer 1>

Comparative polymer 1 was obtained proceeding as in the Production of Crystalline Polyester Resin 1, but changing to the starting materials shown in Table 1. The properties of the obtained comparative polymer 1 are given in Table 2.

<Production of Comparative Polymer 2>

100.0 mass parts of succinic acid, 171.0 mass parts of 1,12-dodecanediol, and 0.5 mass parts of tin di(2-ethylhexanoate) were reacted for 5 hours at 160° C. under a nitrogen atmosphere in a reactor equipped with a stirrer, thermometer, nitrogen inlet line, water separator, and vacuum apparatus. This was followed by reaction for 1 hour at 200° C. and then reaction at 200° C. and 1 hPa until the desired molecular weight was reached to obtain comparative polymer 2. The properties of the obtained comparative polymer 2 are given in Table 2.

<Production of Comparative Polymer 3>

100.0 mass parts of fumaric acid, 101.0 mass parts of 1,6-hexanediol, 0.5 mass parts of dibutyltin oxide, and 0.1 mass parts of hydroquinone were introduced into a reactor equipped with a stirrer, thermometer, nitrogen inlet line, water separator, and vacuum apparatus and were reacted for 5 hours at 160° C. under a nitrogen atmosphere. This was followed by reaction for 1 hour at 200° C. and then reaction at 200° C. and 1 hPa until the desired molecular weight was reached to obtain comparative polymer 3. The properties of the obtained comparative polymer 3 are given in Table 2.

TABLE 1

| | monomer group A | | monomer group B | |
|---|---|---|---|---|
| | monomer | mass parts | monomer | mass parts |
| crystalline polyester resin 2 | 1,10-decanedicarboxylic acid<br>1,10-decanediol | 100.0<br>70.6 | 1,12-dodecanediol | 16.3 |
| crystalline polyester resin 3 | sebacic acid<br>1,10-decanediol | 100.0<br>78.9 | 1,12-dodecanediol | 18.9 |
| crystalline polyester resin 4 | sebacic acid<br>1,9-nonanediol | 100.0<br>72.6 | 1,12-dodecanediol | 18.9 |
| crystalline polyester resin 5 | sebacic acid<br>1,6-hexanediol | 100.0<br>53.5 | 1,12-dodecanediol | 18.9 |
| crystalline polyester resin 6 | sebacic acid<br>ethylene glycol | 100.0<br>27.8 | 1,12-dodecanediol | 21.2 |
| crystalline polyester resin 7 | 1,10-decanedicarboxylic acid<br>1,6-hexanediol | 100.0<br>56.4 | 15-hydroxypentadecanoic acid | 22.0 |
| crystalline polyester resin 8 | 1,10-decanedicarboxylic acid<br>1,6-hexanediol | 100.0<br>45.3 | 1,12-dodecanediol | 15.4 |
| crystalline polyester resin 9 | 1,10-decanedicarboxylic acid<br>1,10-decanediol | 100.0<br>73.6 | 1,12-dodecanediol | 19.3 |
| crystalline polyester resin 10 | 1,10-decanedicarboxylic acid<br>1,6-hexanediol | 100.0<br>69.6 | 1,22-docosanedicarboxylic acid | 37.0 |
| crystalline polyester resin 11 | 10-hydroxydecanoic acid | 100.0 | 15-hydroxypentadecanoic acid | 15.3 |
| crystalline polyester resin 12 | 1,10-decanedicarboxylic acid<br>1,6-hexanediol | 100.0<br>52.6 | 1,12-dodecanediol | 5.6 |
| crystalline polyester resin 13 | 1,10-decanedicarboxylic acid<br>1,6-hexanediol | 100.0<br>43.0 | 1,12-dodecanediol | 22.1 |
| crystalline polyester resin 14 | 1,10-decanedicarboxylic acid<br>1,6-hexanediol | 100.0<br>24.4 | 1,12-dodecanediol | 54.4 |
| crystalline polyester resin 15 | 1,10-decanedicarboxylic acid<br>1,5-pentanediol | 100.0<br>40.3 | 1,12-dodecanediol | 18.4 |
| crystalline polyester resin 16 | sebacic acid<br>1,3-propanediol | 100.0<br>36.9 | 1,12-dodecanediol | 10.5 |
| crystalline polyester resin 17 | 1,10-decanedicarboxylic acid<br>ethylene glycol | 100.0<br>26.5 | 1,12-dodecanediol | 9.3 |
| comparative polymer 1 | sebacic acid<br>1,6-hexanediol | 100.0<br>63.7 | — | — |
| comparative polymer 2 | succinic acid | 100.0 | 1,12-dodecanediol | 171.0 |

TABLE 2

| polymer | content X of monomer (b) unit | Mw | melting point |
|---|---|---|---|
| crystalline polyester resin 1 | 7.9 | 16000 | 71° C. |
| crystalline polyester resin 2 | 8.8 | 13000 | 76° C. |
| crystalline polyester resin 3 | 9.0 | 14000 | 74° C. |
| crystalline polyester resin 4 | 9.0 | 14000 | 66° C. |
| crystalline polyester resin 5 | 9.0 | 15000 | 66° C. |
| crystalline polyester resin 6 | 10.0 | 13000 | 74° C. |
| crystalline polyester resin 7 | 8.5 | 13000 | 71° C. |
| crystalline polyester resin 8 | 8.5 | 30000 | 73° C. |
| crystalline polyester resin 9 | 10.0 | 6000 | 74° C. |
| crystalline polyester resin 10 | 8.3 | 13000 | 73° C. |
| crystalline polyester resin 11 | 10.0 | 13000 | 76° C. |
| crystalline polyester resin 12 | 3.0 | 13000 | 71° C. |
| crystalline polyester resin 13 | 12.0 | 13000 | 71° C. |
| crystalline polyester resin 14 | 30.0 | 13000 | 78° C. |
| crystalline polyester resin 15 | 10.0 | 18000 | 60° C. |
| crystalline polyester resin 16 | 5.0 | 18000 | 53° C. |
| crystalline polyester resin 17 | 5.0 | 15000 | 83° C. |
| comparative polymer 1 | 0.0 | 13000 | 66° C. |
| comparative polymer 2 | 50.0 | 15000 | 79° C. |
| comparative polymer 3 | 0.0 | 18000 | 113° C. |

<Production of Toner 1>

An aqueous medium was prepared by adding 6.0 mass parts of tricalcium phosphate to 630.0 mass parts of deionized water heated to a temperature of 60° C. and stirring at a stirring rate of 15,000 rpm using a TK Homomixer (Tokushu Kika Kogyo Co., Ltd.).

A mixture was then prepared by mixing the following binder resin materials while stirring at a stirring rate of 100 rpm using a propeller-type stirrer.

| | |
|---|---|
| styrene | 69.3 mass parts |
| n-butyl acrylate | 20.7 mass parts |
| crystalline polyester resin 1 | 10.0 mass parts |

To the resulting solution were then added

| | |
|---|---|
| cyan pigment (C. I. Pigment Blue 15:3) | 6.5 mass parts |
| negative charge control agent (BONTRON E-88, Orient Chemical Industries Co., Ltd.) | 0.5 mass parts |
| hydrocarbon wax (melting point = 78° C.) | 9.0 mass parts |
| negative chargeability control resin 1 (styrene/2-ethylhexyl acrylate/2-acrylamido-2-methylpropanesulfonic acid copolymer, acid value = 14.5 mg KOH/g, Tg = 83° C., Mw = 33,000) | 0.7 mass parts |
| polar resin (styrene/2-hydroxyethyl methacrylate/methacrylic acid/methyl methacrylate copolymer, acid value=10 mg KOH/g, Tg=80° C., Mw=15,000) | 5.0 mass parts |

followed by heating the mixture to a temperature of 65° C. and then stirring at a stirring rate of 10,000 rpm using a TK Homomixer (Tokushu Kika Kogyo Co., Ltd.) to effect dissolution and dispersion and thereby produce a polymerizable monomer composition.

This polymerizable monomer composition was introduced into the aforementioned aqueous medium;

Perbutyl PV 5.4 mass parts (10-hour half-life temperature=54.6° C. (NOF Corporation))

was added; and stirring and granulation were carried out for 20 minutes at a temperature of 70° C. at a stirring rate of 15,000 rpm using a TK Homomixer.

This was followed by transfer to a propeller-type stirrer, and the styrene and n-butyl acrylate, which were the polymerizable monomers in the polymerizable monomer composition, were polymerized for 5 hours at a temperature of 85° C. while stirring at a stirring rate of 200 rpm to produce a toner particle-containing slurry. This slurry was cooled after the completion of the polymerization reaction. Hydrochloric acid was added to the cooled slurry to bring its pH to 1.4, and the calcium phosphate salt was dissolved by stirring for 1 hour. The slurry was then washed with 10-fold water, filtered, and dried and the particle diameter was adjusted by classification to obtain toner particles. The toner particles contained 90.0 mass parts of a styrene-acrylic binder resin, 10.0 mass parts of crystalline polyester resin 1, 6.5 mass parts of the cyan pigment, 9.0 mass parts of the wax, 0.5 mass parts of the negative chargeability control agent, 0.7 mass parts of negative chargeability control resin 1, and 5.0 mass parts of the polar resin.

1.5 mass parts of hydrophobic silica fine particles (primary particle diameter: 7 nm, BET specific surface area: 130 $m^2/g$), as provided by treating silica fine particles with 20 mass % of a dimethylsilicone oil, was mixed as an external additive using a Henschel mixer (Mitsui Miike Chemical Engineering Machinery Co., Ltd.) for 15 minutes at a stirring rate of 3000 rpm with 100.0 mass parts of these toner particles to obtain a toner 1. Toner 1 had a number-average particle diameter D1=4.3 μm and a weight-average particle diameter D4=5.7 μm.

<Production of Toners 2 to 22>

Toners 2 to 22 were obtained by the same production method as for toner 1, but changing to the starting materials and parts of addition given in Table 3. It was confirmed that the component percentages for the constituent materials in the toner particles of toners 2 to 22 were equal to the addition percentages of the starting materials just as for toner 1. The properties of toners 2 to 22 are given in Table 3.

TABLE 3

| toner | binder resin | mass parts | mass parts of initiator | toner properties D1 (μm) | D4 (μm) | Mw |
|---|---|---|---|---|---|---|
| toner 2 | crystalline polyester resin 2 | 10.0 | 5.4 | 4.7 | 5.8 | 29000 |
| | styrene:n-butyl acrylate (77:23) | 90.0 | | | | |
| toner 3 | crystalline polyester resin 3 | 10.0 | 5.4 | 4.8 | 5.8 | 29000 |
| | styrene:n-butyl acrylate (77:23) | 90.0 | | | | |
| toner 4 | crystalline polyester resin 4 | 10.0 | 5.4 | 4.3 | 5.7 | 30000 |
| | styrene:n-butyl acrylate (77:23) | 90.0 | | | | |
| toner 5 | crystalline polyester resin 5 | 10.0 | 5.4 | 4.7 | 5.9 | 29000 |
| | styrene:n-butyl acrylate (77:23) | 90.0 | | | | |
| toner 6 | crystalline polyester resin 6 | 10.0 | 5.4 | 4.5 | 5.7 | 30000 |
| | styrene:n-butyl acrylate (77:23) | 90.0 | | | | |
| toner 7 | crystalline polyester resin 7 | 10.0 | 5.4 | 4.7 | 5.8 | 29000 |
| | styrene:n-butyl acrylate (77:23) | 90.0 | | | | |
| toner 8 | crystalline polyester resin 8 | 10.0 | 5.4 | 4.8 | 5.8 | 31000 |
| | styrene:n-butyl acrylate (77:23) | 90.0 | | | | |
| toner 9 | crystalline polyester resin 9 | 10.0 | 5.4 | 4.3 | 5.7 | 29000 |
| | styrene:n-butyl acrylate (77:23) | 90.0 | | | | |
| toner 10 | crystalline polyester resin 10 | 10.0 | 5.4 | 4.7 | 5.9 | 29000 |
| | styrene:n-butyl acrylate (77:23) | 90.0 | | | | |
| toner 11 | crystalline polyester resin 1 | 3.0 | 5.8 | 4.3 | 5.7 | 30000 |
| | styrene:n-butyl acrylate (77:23) | 97.0 | | | | |
| toner 12 | crystalline polyester resin 1 | 5.0 | 5.7 | 5.0 | 6.3 | 30000 |
| | styrene:n-butyl acrylate (77:23) | 95.0 | | | | |
| toner 13 | crystalline polyester resin 1 | 20.0 | 4.8 | 4.3 | 5.7 | 29000 |
| | styrene:n-butyl acrylate (77:23) | 80.0 | | | | |
| toner 14 | crystalline polyester resin 1 | 30.0 | 4.2 | 4.8 | 5.8 | 28000 |
| | styrene:n-butyl acrylate (77:23) | 70.0 | | | | |
| toner 15 | crystalline polyester resin 1 | 40.0 | 3.7 | 4.7 | 5.8 | 28000 |
| | styrene:n-butyl acrylate (77:23) | 60.0 | | | | |
| toner 16 | crystalline polyester resin 11 | 10.0 | 5.4 | 4.8 | 5.8 | 29000 |
| | styrene:n-butyl acrylate (77:23) | 90.0 | | | | |
| toner 17 | crystalline polyester resin 12 | 10.0 | 5.4 | 4.7 | 5.7 | 29000 |
| | styrene:n-butyl acrylate (77:23) | 90.0 | | | | |
| toner 18 | crystalline polyester resin 13 | 10.0 | 5.4 | 4.3 | 5.8 | 29000 |
| | styrene:n-butyl acrylate (77:23) | 90.0 | | | | |
| toner 19 | crystalline polyester resin 14 | 10.0 | 5.4 | 4.7 | 5.7 | 30000 |
| | styrene:n-butyl acrylate (77:23) | 90.0 | | | | |
| toner 20 | crystalline polyester resin 15 | 10.0 | 5.4 | 4.8 | 5.7 | 30000 |
| | styrene:n-butyl acrylate (77:23) | 90.0 | | | | |
| toner 21 | crystalline polyester resin 16 | 10.0 | 5.4 | 4.7 | 5.8 | 30000 |
| | styrene:n-butyl acrylate (77:23) | 90.0 | | | | |
| toner 22 | crystalline polyester resin 17 | 10.0 | 5.4 | 4.7 | 5.8 | 30000 |
| | styrene:n-butyl acrylate (77:23) | 90.0 | | | | |

<Production of Toner 23>

The materials listed below were preliminarily mixed and were then melt kneaded using a twin-screw extruder; the cooled kneadate was coarsely pulverized using a hammer mill; and the obtained fine pulverized material was classified to obtain toner particles.

| | |
|---|---|
| binder resin polymer 1 | 90.0 mass parts |
| crystalline polyester resin 1 | 10.0 mass parts |
| C. I. Pigment Blue 15:3 | 5.5 mass parts |
| metal compound of dialkylsalicylic acid (BONTRON E88 from Orient Chemical Industries Co., Ltd.) | 3.0 mass parts |
| hydrocarbon wax (melting point = 78° C.) | 6.0 mass parts |

1.5 mass parts of hydrophobic silica fine particles (primary particle diameter: 7 nm, BET specific surface area: 130 $m^2/g$), as provided by treating silica fine particles with 20.0 mass % of a dimethylsilicone oil, was mixed as an external additive using a Henschel mixer (Mitsui Miike Chemical Engineering Machinery Co., Ltd.) for 15 minutes at a stirring rate of 3000 rpm with 100.0 mass parts of the obtained toner particles to obtain a toner 23. It was confirmed that the component percentages for the constituent materials in the toner particle of toner 23 were equal to the addition percentages of the starting materials just as for toner 1. Toner 23 had D1=4.5 μm and D4=6.0 μm.

<Production of Toner 24>

A toner 24 was obtained using the same production method as for toner 23, but changing the binder resin polymer 1 to a styrene-n-butyl acrylate copolymer resin (Mw=30,000, Tg=55° C.). It was confirmed that the component percentages for the constituent materials in the toner particle of toner 24 were equal to the addition percentages for the starting materials just as for toner 1. Toner 24 had D1=4.4 μm and D4=5.9 μm.

<Production of Toner 25>

A toner 25 was obtained using the same production method as for toner 23, but changing the binder resin polymer 1 to a styrene-n-butyl acrylate copolymer resin (Mw=30,000, Tg=55° C.) and changing the crystalline polyester resin 1 to crystalline polyester resin 3. It was confirmed that the component percentages for the constituent materials in the toner particle of toner 25 were equal to the addition percentages for the starting materials just as for toner 1. Toner 25 had D1=4.4 μm and D4=5.8 μm.

<Production of Toner 26>

(Production of Resin Particle Dispersion 1)

| | |
|---|---|
| styrene | 80.0 mass parts |
| n-butyl acrylate | 20.0 mass parts |

The preceding were mixed together and dissolved and this was then dispersed and emulsified in 120.0 mass parts of deionized water in which 1.5 mass parts of a nonionic surfactant (Nonipol 400 from Sanyo Chemical Industries, Ltd.) and 2.2 mass parts of an anionic surfactant (Neogen SC from Dai-ichi Kogyo Seiyaku Co., Ltd.) had already been dissolved. This was followed, while slowly mixing for 10 minutes, by the introduction of 10.0 mass parts deionized water in which 1.5 mass parts of the polymerization initiator ammonium persulfate had been dissolved. After nitrogen replacement had been carried out and while stirring, the contents were heated to a temperature of 70° C. and an emulsion polymerization was continued in this state for 4 hours to produce a resin particle dispersion 1 in which resin particles having an average particle diameter of 0.29 μm were dispersed.

(Production of Resin Particle Dispersion 2)

A solution of

| | |
|---|---|
| crystalline polyester resin 1 | 100.0 mass parts |
| methyl ethyl ketone | 300.0 mass parts |

was dispersed and emulsified in a solution of 1.5 mass parts of a nonionic surfactant (Nonipol 400 from Sanyo Chemical Industries, Ltd.) and 2.2 mass parts of an anionic surfactant (Neogen SC from Dai-ichi Kogyo Seiyaku Co., Ltd.) dissolved in 1200.0 mass parts of deionized water. This produced resin particle dispersion 2, in which resin particles having an average particle diameter of 0.30 μm were dispersed.

(Production of a Pigment Dispersion)

| | |
|---|---|
| cyan pigment (C. I. Pigment Blue 15:3) | 20.0 mass parts |
| anionic surfactant (Neogen SC from Dai-ichi Kogyo Seiyaku Co., Ltd.) | 3.0 mass parts |
| deionized water | 78.0 mass parts |

The preceding were mixed and dispersion was performed using a sand grinder mill. When the particle size distribution of this pigment dispersion was measured using a particle size distribution analyzer (LA-700 from Horiba, Ltd.), the average particle diameter of the contained pigment was 0.20 μm and coarse particles larger than 1 μm were not observed.

(Production of a Wax Particle Dispersion)

| | |
|---|---|
| hydrocarbon wax (melting point = 78° C.) | 50.0 mass parts |
| anionic surfactant (Neogen SC from Dai-ichi Kogyo Seiyaku Co., Ltd.) | 7.0 mass parts |
| deionized water | 200.0 mass parts |

The preceding were heated to a temperature of 95° C. and dispersion was carried out using an homogenizer (Ultra-Turrax T50 from IKA). This was followed by dispersion processing with a pressure ejection homogenizer to produce a wax particle dispersion in which wax with an average particle diameter of 0.50 μm was dispersed.

(Production of a Charge Control Particle Dispersion)

| | |
|---|---|
| metal compound of dialkylsalicylic acid (negative chargeability control agent, BONTRON E-84 from Orient Chemical Industries Co., Ltd.) | 5.0 mass parts |
| anionic surfactant (Neogen SC from Dai-ichi Kogyo Seiyaku Co., Ltd.) | 3.0 mass parts |
| deionized water | 78.0 mass parts |

The preceding were mixed and were dispersed using a sand grinder mill.

(Production of a Mixture)

| | |
|---|---|
| resin particle dispersion 1 | 210.0 mass parts |
| resin particle dispersion 2 | 163.0 mass parts |
| pigment dispersion | 28.0 mass parts |
| wax particle dispersion | 47.0 mass parts |
| charge control particle dispersion | 10.5 mass parts |

The preceding were introduced into a reactor equipped with a stirrer, condenser, and thermometer and were stirred. The mixture was adjusted to pH=5.2 using 1 mol/L potassium hydroxide.

120.0 mass parts of an 8% aqueous sodium chloride solution was added dropwise as an aggregating agent to the resulting mixture, and heating to a temperature of 55° C. was carried out while stirring. When this temperature was reached, 10.0 mass parts of the charge control particle dispersion was added. After holding for 2 hours at a temperature of 55° C., it was confirmed by observation with an optical microscope that aggregate particles having an average particle diameter of 3.2 μm had been formed.

This was followed by a supplemental addition of 3.0 mass parts of an anionic surfactant (Neogen SC from Dai-ichi Kogyo Seiyaku Co., Ltd.) and then heating to a temperature of 95° C. and holding for 4.5 hours while continuing to stir. After cooling, the reaction product was filtered off and was thoroughly washed with deionized water; this was followed by fluidized bed drying at a temperature of 45° C. to obtain toner particles. The toner particles contained 90.0 mass parts of a styrene-acrylic binder resin, 10.0 mass parts of crystalline polyester resin 1, 5.5 mass parts of the cyan pigment, 9.0 mass parts of the wax, and 0.6 mass parts of the negative chargeability control agent.

1.5 mass parts of hydrophobic silica fine particles (primary particle diameter: 7 nm, BET specific surface area: 130 $m^2/g$), as provided by treating silica fine particles with 20.0 mass % of a dimethylsilicone oil, was mixed as an external additive using a Henschel mixer (Mitsui Miike Chemical Engineering Machinery Co., Ltd.) for 15 minutes at a stirring rate of 3000 rpm with 100.0 mass parts of the obtained toner particles to obtain a toner 26. Toner 26 had D1=4.5 μm and D4=6.4 μm.

<Production of Toner 27>

A toner 27 was obtained using the same production method as for toner 26, but producing and using the resin particle dispersion 3 described below rather than producing and using resin particle dispersion 1. It was confirmed that the component percentages for the constituent materials in the toner particle of toner 27 were equal to the addition percentages for the starting materials just as for toner 1. Toner 27 had D1=4.6 μm and D4=6.6 μm.

(Production of Resin Particle Dispersion 3)

A solution of

| | |
|---|---|
| binder resin polymer 1 | 100.0 mass parts |
| methyl ethyl ketone | 300.0 mass parts |

was dispersed and emulsified in a solution of 1.5 mass parts of a nonionic surfactant (Nonipol 400 from Sanyo Chemical Industries, Ltd.) and 2.2 mass parts of an anionic surfactant (Neogen SC from Dai-ichi Kogyo Seiyaku Co., Ltd.) dissolved in 1200.0 mass parts of deionized water. This produced resin particle dispersion 3, in which resin particles having an average particle diameter of 0.30 μm were dispersed.

<Production of Toner 28>

| | |
|---|---|
| styrene-acrylic binder resin (copolymer of styrene:n-butyl acrylate = 80:20 (mass ratio)) (Mw = 30,000, Tg = 55° C.) | 90.0 mass parts |
| crystalline polyester resin 1 | 10.0 mass parts |
| methyl ethyl ketone | 100.0 mass parts |
| ethyl acetate | 100.0 mass parts |
| hydrocarbon wax (melting point = 78° C.) | 9.0 mass parts |
| cyan pigment (C. I. Pigment Blue 15:3) | 6.5 mass parts |
| negative chargeability control resin 1 | 1.0 mass parts |

(styrene/2-ethylhexyl acrylate/2-acrylamido-2-methylpropanesulfonic acid copolymer, acid value=14.5 mg KOH/g, Tg=83° C., Mw=33,000)

These materials were dispersed for 3 hours using an attritor (Mitsui Mining & Smelting Co., Ltd.) to obtain a pigment dispersion.

Otherwise, 27.0 mass parts of calcium phosphate was added to 3000.0 mass parts of deionized water that had been heated to a temperature of 60° C. and an aqueous medium was then prepared by stirring at a stirring rate of 10,000 rpm using a TK Homomixer (Tokushu Kika Kogyo Co., Ltd.). The aforementioned pigment dispersion was introduced into this aqueous medium and the pigment was granulated under an $N_2$ atmosphere at a temperature of 65° C. by stirring for 15 minutes at a stirring speed of 12,000 rpm using a TK Homomixer. The TK Homomixer was then changed over to an ordinary propeller stirrer, and, while holding the stirring rate of the stirrer at 150 rpm, a toner particle dispersion was produced by raising the internal temperature to a temperature of 95° C. and holding for 3 hours in order to remove the solvent from the dispersion.

The calcium phosphate salt was dissolved by adding hydrochloric acid to the obtained toner particle dispersion to bring the pH to 1.4 and stirring for 1 hour. A toner cake was obtained by filtration•washing of this dispersion on a pressure filter. This was followed by pulverization of the toner cake and drying to obtain toner particles. The toner particle contained 90.0 mass parts of a styrene-acrylic binder resin, 10.0 mass parts of the crystalline polyester resin 1, 6.5 parts of the cyan pigment, 9.0 mass parts of the wax, and 1.0 mass parts of the negative chargeability control resin 1. 1.5 mass parts of hydrophobic silica fine particles (primary particle diameter: 7 nm, BET specific surface area: 130 $m^2/g$), as provided by treating silica fine particles with 20 mass % of a dimethylsilicone oil, was mixed as an external additive using a Henschel mixer (Mitsui Miike Chemical Engineering Machinery Co., Ltd.) for 15 minutes at a stirring rate of 3000 rpm with 100.0 mass parts of the obtained toner particles to obtain a toner 28. Toner 28 had D1=3.9 μm and D4=6.4 μm.

<Production of Toner 29>

A toner 29 was obtained by the same production method as for toner 28, but changing the styrene-acrylic binder resin to binder resin polymer 1. It was confirmed that the component percentages for the constituent materials in the toner particle of toner 29 were equal to the addition percentages of the starting materials just as for toner 1. Toner 29 had D1=4.6 μm and D4=5.9 μm.

<Production of Comparative Toners 1 and 2>

Comparative toners 1 and 2 were obtained by the same production method as for toner 28, but changing the crystalline polyester resin 1 to, respectively, comparative polymer 1 and comparative polymer 2. It was confirmed that the component percentages for the constituent materials in the toner particles of comparative toners 1 and 2 were equal to the addition percentages of the starting materials just as for toner 1. Comparative toner 1 had D1=3.8 μm and D4=6.4 μm. Comparative toner 2 had D1=3.7 μm and D4=6.5 μm.

<Production of Comparative Toner 3>

Comparative toner 3 was obtained by the same production method as for toner 28, but changing the crystalline polyester resin 1 to comparative polymer 3 and admixing bis(p-methylbenzylidene)sorbitol at 0.4 mass % with reference to comparative polymer 3. It was confirmed that the component percentages for the constituent materials in the toner particle of comparative toner 3 were equal to the addition percentages of the starting materials just as for toner 1. Comparative toner 3 had D1=3.7 μm and D4=6.3 μm.

<Image Evaluations>

The image evaluations were carried out using a partially modified commercial color laser printer (HP Color LaserJet 3525dn). The modifications enabled operation with just a single color process cartridge installed. The modifications also enabled the temperature at the fixing unit to be freely changed.

The toner present in the black toner process cartridge mounted in this color laser printer was removed and the interior was cleaned with an air blower; the particular toner (300 g) was then introduced into the process cartridge; the process cartridge refilled with toner was mounted in the color laser printer; and image evaluation was carried out as indicated below. The specific items in the image evaluation are as follows.

(The Low-Temperature Fixability)

The evaluation was carried out by fixing a solid image (toner laid-on amount: 0.9 mg/cm$^2$) to the transfer material at different fixation temperatures. Here, the fixation temperature is the value measured for the fixing roller surface using a noncontact thermometer. Letter-size general-purpose paper (Xerox 4200 paper, from Xerox Corporation, 75 g/m$^2$) was used as the transfer material. In the present invention, an evaluation of C or above is an acceptable level.

(Evaluation Criteria)

A: no offset at 110° C.

B: offset is produced at 110° C.

C: offset is produced at 120° C.

D: offset is produced at 130° C.

(Temporal Stability of the Low-Temperature Fixability)

Each toner was held for 3 days at a temperature of 50° C./humidity of 10% RH; fixing was then carried out by the same method as above for the low-temperature fixability; and the change in the fixation temperature pre-versus-post-holding was evaluated. In the present invention, an evaluation of C or above is an acceptable level.

(Evaluation Criteria)

A: no change

B: 5° C. worse

C: 10° C. worse

D: 15° C. worse (Heat-Resistant Storability (Blocking))

Each toner (5 g) was placed in a 50-cc plastic cup and was held for 3 days at a temperature of 55° C./humidity of 10% RH, after which the evaluation was performed by checking for the presence/absence of aggregate lumps. In the present invention, an evaluation of C or above is an acceptable level.

(Evaluation Criteria)

A: aggregate lumps are not produced

B: minor aggregate lumps are produced and are broken up by light finger pressure C: aggregate lumps are produced and are not broken up even by light finger pressure D: complete aggregation Examples 1 to 29

The preceding evaluations were carried out in Examples 1 to 29 using each of toners 1 to 29 as the toner. The results of the evaluations are given in Table 4.

Comparative Examples 1 to 3

The preceding evaluations were carried out in Comparative Examples 1 to 3 using each of comparative toners 1 to 3 as the toner. The results of the evaluations are given in Table 4.

TABLE 4

| Example | toner | low-temperature fixability | temporal stability of the low-temperature fixability | heat-resistant storability |
|---|---|---|---|---|
| Example 1 | toner 1 | A | A | A |
| Example 2 | toner 2 | A | A | A |
| Example 3 | toner 3 | A | A | A |
| Example 4 | toner 4 | A | A | A |
| Example 5 | toner 5 | A | A | A |
| Example 6 | toner 6 | A | A | A |
| Example 7 | toner 7 | A | A | A |
| Example 8 | toner 8 | B | A | A |
| Example 9 | toner 9 | A | A | B |
| Example 10 | toner 10 | B | A | A |
| Example 11 | toner 11 | B | A | A |
| Example 12 | toner 12 | A | A | A |
| Example 13 | toner 13 | A | A | A |
| Example 14 | toner 14 | B | A | A |
| Example 15 | toner 15 | C | B | A |
| Example 16 | toner 16 | C | A | A |
| Example 17 | toner 17 | A | B | B |
| Example 18 | toner 18 | B | A | A |
| Example 19 | toner 19 | C | A | A |
| Example 20 | toner 20 | A | B | B |
| Example 21 | toner 21 | A | B | C |
| Example 22 | toner 22 | C | A | A |
| Example 23 | toner 23 | B | B | C |
| Example 24 | toner 24 | A | A | B |
| Example 25 | toner 25 | A | A | B |
| Example 26 | toner 26 | B | A | B |
| Example 27 | toner 27 | B | A | C |
| Example 28 | toner 28 | B | A | B |
| Example 29 | toner 29 | B | B | C |
| Comparative Example 1 | comparative toner 1 | B | D | D |
| Comparative Example 2 | comparative toner 2 | D | D | C |
| Comparative Example 3 | comparative toner 3 | C | D | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-127245, filed Jun. 20, 2014, and No. 2015-110144, filed May 29, 2015 which are hereby incorporated by reference herein in their entirety.

What is claimed is:

1. A toner comprising a toner particle, said toner particle comprising:

a pigment, the pigment being at least one member selected from the group consisting of an organic pigment and a carbon black; and a binder resin, the binder resin comprising styrene-acrylic resin, and a crystalline polyester resin, the crystalline polyester resin being obtained by condensation polymerization of a monomer (a) selected from monomer group A described below and a monomer (b) selected from monomer group B described below, wherein the crystalline polyester resin has a content X (mol %) of the unit derived from the monomer (b), as calculated by formula (1) of from 3.0 to 12.0 mol %:

$$X=\{Mb/(Ma+Mb)\}\times 100 \quad (1)$$

where Ma (mol/g) is the number of moles of the unit derived from the monomer (a) per unit mass, and Mb (mol/g) is the number of moles of the unit derived from the monomer (b) per unit mass, and a melting point of the crystalline polyester resin is from 50 to 85° C., monomer group A comprises a $C_{2-11}$ α,ω-straight-chain aliphatic diol, a $C_{2-13}$ α,ω-straight-chain aliphatic dicarboxylic acid, a $C_{2-12}$ α,ω-straight-chain aliphatic monohydroxymonocarboxylic acid, an intramolecular anhydride of a $C_{2-13}$ α,ω-straight-chain aliphatic dicarboxylic acid, an alkylester of a $C_{2-13}$ α,ω-straight-chain aliphatic dicarboxylic acid, an alkylester of a $C_{2-12}$ α,ω-straight-chain aliphatic monohydroxymonocarboxylic acid, or a lactonized compound of a $C_{2-12}$ α,ω-straight-chain aliphatic monohydroxymonocarboxylic acid, and monomer group B comprises a $C_{12-22}$ α,ω-straight-chain aliphatic diol, a $C_{14-24}$ α,ω-straight-chain aliphatic dicarboxylic acid, a $C_{13-23}$ α,ω-straight-chain aliphatic monohydroxymonocarboxylic acid, an intramolecular anhydride of a $C_{14-24}$ α,ω-straight-chain aliphatic dicarboxylic acid, an alkylester of a $C_{14-24}$ α,ω-straight-chain aliphatic dicarboxylic acid, an alkylester of a $C_{13-23}$ α,ω-straight-chain aliphatic monohydroxymonocarboxylic acid, or a lactonized compound of a $C_{13-23}$ α,ω-straight-chain aliphatic monohydroxymonocarboxylic acid.

2. The toner according to claim 1, wherein the toner particle contains the crystalline polyester resin at from 3.0 to 30.0 mass% based on the total mass of the binder resin.

3. The toner according to claim 1, wherein the crystalline polyester resin is a ternary copolymer.

4. The toner according to claim 1, wherein the monomer group A comprises the $C_{2-10}$ α,ω-straight-chain aliphatic diol, the $C_{2-12}$ α,ω- straight-chain aliphatic dicarboxylic acid, or the $C_{2-11}$ α,ω-straight-chain aliphatic monohydroxymonocarboxylic acid.

5. The toner according to claim 1, wherein the organic pigment is a cyan pigment, a magenta pigment, or a yellow pigment.

6. The toner according to claim 1, wherein the monomer group A comprises the $C_{2-11}$ α,ω-straight-chain aliphatic diol, a $C_{5-13}$ α,ω-straight-chain aliphatic dicarboxylic acid, or the $C_{2-12}$ α,ω-straight-chain aliphatic monohydroxymonocarboxylic acid.

7. The toner according to claim 1, wherein the monomer group A comprises the $C_{2-11}$ α,ω-straight-chain aliphatic diol, a $C_{10-13}$ α,ω-straight-chain aliphatic dicarboxylic acid, or the $C_{2-12}$ α,ω-straight-chain aliphatic monohydroxymonocarboxylic acid.

* * * * *